United States Patent [19]

Skeist et al.

[11] Patent Number: 4,514,662

[45] Date of Patent: Apr. 30, 1985

[54] MAGNETIC ARC SPREADING FLUORESCENT LAMPS

[76] Inventors: S. Merrill Skeist, 1620 Cedar Swamp Rd., Brookville Glen Head, N.Y. 11545; Leo Gross, 3611 217 St., Bayside, N.Y. 11361

[21] Appl. No.: 235,306

[22] Filed: Feb. 17, 1981

Related U.S. Application Data

[63] Continuation of Ser. No. 45,589, Jun. 4, 1979, , and a continuation of Ser. No. 93,053, Nov. 13, 1979.

[51] Int. Cl.[3] ..... H01J 7/44; H01J 13/46; H01J 19/78; H01J 29/96; H01K 1/62

[52] U.S. Cl. ..... 315/57; 313/161; 313/493; 315/70

[58] Field of Search ..... 315/57, 70, 73, 56, 315/60; 313/490, 493, 161, 61

[56] References Cited

U.S. PATENT DOCUMENTS

| | | | |
|---|---|---|---|
| 2,030,401 | 2/1936 | Ruff | 315/56 |
| 2,087,753 | 7/1937 | Davies | 313/161 X |
| 2,301,670 | 11/1942 | Abadie | 315/62 X |
| 2,441,510 | 11/1946 | Abadie | 313/161 X |
| 3,551,736 | 12/1970 | Doehner | 313/493 |
| 4,069,416 | 1/1978 | Suga | 313/161 |
| 4,177,401 | 12/1979 | Yamane et al. | 313/161 |

FOREIGN PATENT DOCUMENTS

| | | | |
|---|---|---|---|
| 54-121580 | 9/1979 | Japan | 313/493 |

*Primary Examiner*—Saxfield Chatmon

*Attorney, Agent, or Firm*—Lackenbach Siegel Marzullo Presta & Aronson

[57] ABSTRACT

An arc discharge device such as a fluorescent lamp without partitions, such as a double walled hemisphere or portion thereof, a double walled conical section, a double walled cylinder, which are more intensely and fully illuminated by magnetic arc spreading techniques. The magnetic field is concentrated in the region just beyond the source of the arc to maximize the spreading effect.

12 Claims, 5 Drawing Figures

MAGNETIC ARC SPREADING FLUORESCENT LAMPS

REFERENCE TO RELATED APPLICATIONS

This application is copending with application Ser. Nos. 045,589, filed June 4, 1979 and 093,053, filed Nov. 13, 1979.

BACKGROUND OF THE INVENTION

1. Field of the Invention

The present invention relates to fluorescent lamps having shapes that appear to depart from conventional circular cross-sectional configurations.

2. Description of the Prior Art

Fluorescent lamps have previously been devices which are internally partitioned and the arc is confined to a pathway that is essentially circular in cross section. Recent descriptions of such lamps are the compact fluorescent lamps described by Young et al. in U.S. Pat. Nos. 4,185,221, 4,184,101, 4,173,730, 4,182,975 and 3,903,447, and Rogoff in U.S. Pat. No. 4,191,907, wherein metal partitions are employed. Glass partitioning is described in the U.S. patents of LoGuidice, U.S. Pat. No. 3,953,761, Jones, U.S. Pat. No. 3,646,383, Taxil et al., U.S. Pat. No. 3,848,150. Some of these lamps are single ended, compact and fitted with a screw base to mate with the ubiquitous Edison incandescent socket. Partitioning to accomplish the same aims has been attempted by other workers in the fluorescent lamp art dating back to Barclay, U.S. Pat. No. 2,121,133, in 1938. All of the these lamp designs seek to maximize light output by keeping the stationary arc no further than one inch (1") from the phosphored glass surface by means of the partitions. A fluorescent lamp with greater than one inch (1") spacing within the lamp volumes was disclosed by Campbell, U.S. Pat. No. 3,928,786, who switched the arc between multiple electrodes at high frequency. Yamane, U.S. Pat. No. 4,177,401, filled a double cylinder fluorescent lamp by placing a permanent magnet at the exit port of the inner cylinder. Gross and Skeist, U.S. Pat. No. 4,187,446, with magnetic arc spreading techniques, caused the arc to traverse the entire volume of a double cylinder with one or more partitions in a compact fluorescent lamp with a screw base.

SUMMARY OF THE INVENTION

Prior art fluorescent lamps function satisfactorily though they all require lamp envelopes with some form of partitioning. However, this may be accomplished, whether with glass, metal or other barriers to the arc, such structures cost more to fabricate than a lamp without partitions.

The present invention applies magnetic arc spreading to fluorescent lamps with lamp envelopes of novel shapes without partitions. Thus, a broader region is inhabited by the arc which is swept through the entire volume of the lamp by magnetic arc spreading.

The structures of magnetic arc spreading lamps without partitions are clearly seen in the accompanying drawings wherein:

DETAILED DESCRIPTION OF THE INVENTION

The accompanying drawings illustrate various configurations of the invention. In U.S. Pat. No. 4,187,446, Gross and Skeist described the techniques of magnetic arc spreading as applied to a compact fluorescent lamp with a screw base. For a fluorescent lamp to occupy minimum volume, partitioning of the lamp envelope may be one resort; however, it is simpler to manufacture fluorescent lamps that do not have partitions. Such fluorescent lamps utilizing magnetic arc spreading can be fabricated in new and novel shapes not previously described.

Figure 1:
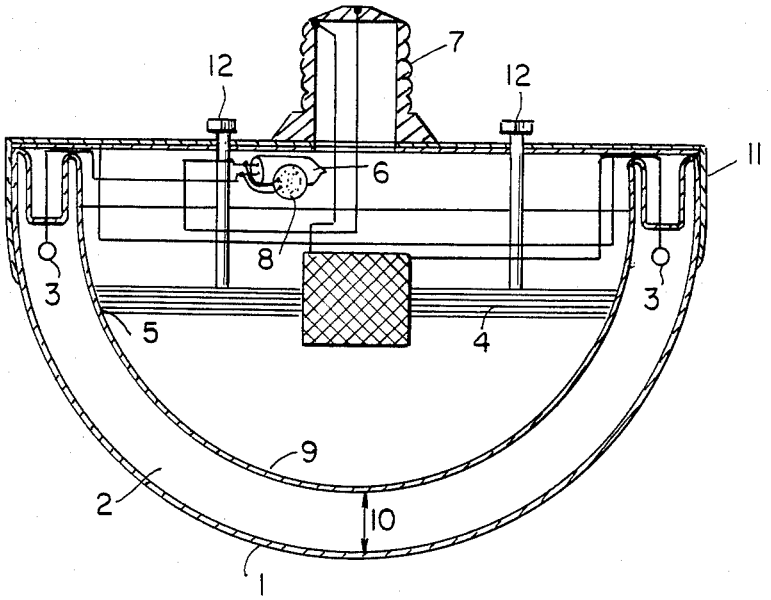
FIG. 1, is a pictorial view of a hemispherical fluorescent magnetic arc spreading lamp.

FIG. 1 illustrates the general shape of one embodiment of the invention. This fluorescent lamp comprises a double walled envelope 1 of hemispherical shape. The interior of the lamp 2 containing argon at a pressure of 1–2 mm and approximately 50 mg of mercury carries the arc discharge. The filaments 3, electrodes, are the origination and termination points of the arc discharge. The insdie region of the hemispherical lamp contains the magnetic arc spreading coil 4, whose pole faces 5, are in close proximity to the interior wall of the lamp envelope and placed 2 to 4 cm away from the filaments where the magnetic field of the arc spreading coil has a maximum effect on spreading the arc throughout the volume of the lamp. One terminal of each filament is conneced to a starter 6. The arc spreading coil 4 is connected in series with the lamp and a filament terminal and the other end of the arc spreading coil 4 is wired to an Edison screw base 7. A capacitor 8 is wired in parallel with the starter 6. This fluorescent lamp is then compatible with Edison sockets. Magnetic arc spreading lamps are considerably more energy efficient than incandescent lamps, which they can replace with concomitant savings. The inside of the interior wall 9 of the lamp envelope is coated with a reflective material, e.g. titanium dioxide to reflect to the outside the light produced by the phosphor. Any other white refractory oxide can be substituted for titanium dioxide. The hemispherical lamp can be constructed in various sizes to create a fluorescent lamp of various wattages by changing the outside diameter and/or the spacing 10 between the walls of the lamp envelope. The arc path is of approximately equal length in any direction between the electrodes. To achieve maximum effect from magnetic arc spreading, the arc will lie in the middle of the lamp envelope in the absence of a magnetic field, i.e. when the arc current is zero, twice during each cycle of the AC power source. To insure this situation, the filaments are inserted a small distance into the envelope, making this direction the shortest path; alternatively, a small amount of radioactive material, such as titanium hydride containing tritium, can be painted along the line of the desired path to reduce the electrical resistance in this direction by "keep alive" ionization, or both techniques can be used simultaneously.

Figure 2:
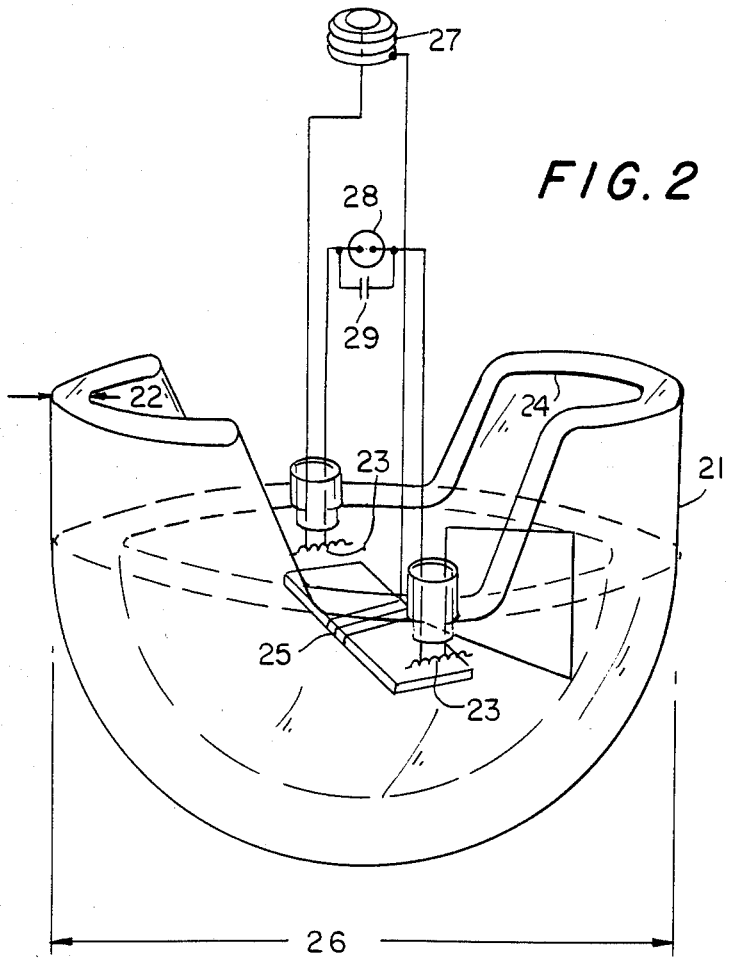
FIG. 2 is a pictorial view of a cylindrical extension on a hemispherical base for a magnetic arc spreading fluorescent lmap.

Increased phosphored surface, wider arc spreading and increased lamp current is achieved by the lamp structure disclosed in FIG. 2. This magnetic arc spreading fluorescent lamp envelope 2 consists of a modified double walled cylinder atop a double walled hemisphere. The interior of the lamp 22 contains argon at a pressure of 1–2 mm and approximately 50 mg of mercury. The filaments 23, electrodes, are the origination and termination points of the arc discharge. The interior cavity of the hemispherical lamp contains the magnetic arc spreading coil 25, whose pole faces are in close proximity to the interior wall of the lamp wall of the lamp envelope and placed 2 to 4 cm away from the filaments 23 where the magnetic field of the arc spreading coil 25 has a maximum effect on spreading the arc throughout the volume of the lamp. The associated circuitry is similar to that described for the lamp configuration of FIG. 1 and this lamp is furnished with a screw base plug 27 compatible with an Edison socket. One terminal of each filament 23 is connected to a starter 28, and a capacitor 29 is connected in parallel with the starter 28.

The inside of the interior wall 24 is coated with a reflective material, e.g. titanium dioxide to reflect outside light produced by the phosphor that coats all inside surfaces of the lamp envelope. Any other white refractory oxide can be substituted for titanium dioxide. The size of the hemispherical lamp can be constructed in various sizes to create a fluorescent lamp of various wattages by changing the diameter and/or the spacing between the walls of the lamp envelope.

The arc path is of approximately equal length in any direction between the electrodes. To achieve maximum effect from magnetic arc spreading, the arc will lie in the middle of the lamp envelope in the absence of a magnetic field, i.e. where the arc current is zero, twice during each cycle of the AC power source. To insure this situation, the filaments are inserted a small distance into the envelope, making this direction the shortest path; alternatively a small amount of radioactive material, such as titanium hydride containing tritium, can be painted along the line of the desired path to reduce the electrical resistance in this direction by "keep alive" ionization, or both techniques can be used simultaneously. The output of the fluorescent lamp can be varied by varying the outside diameter 26 of the lamp.

Figure 3:
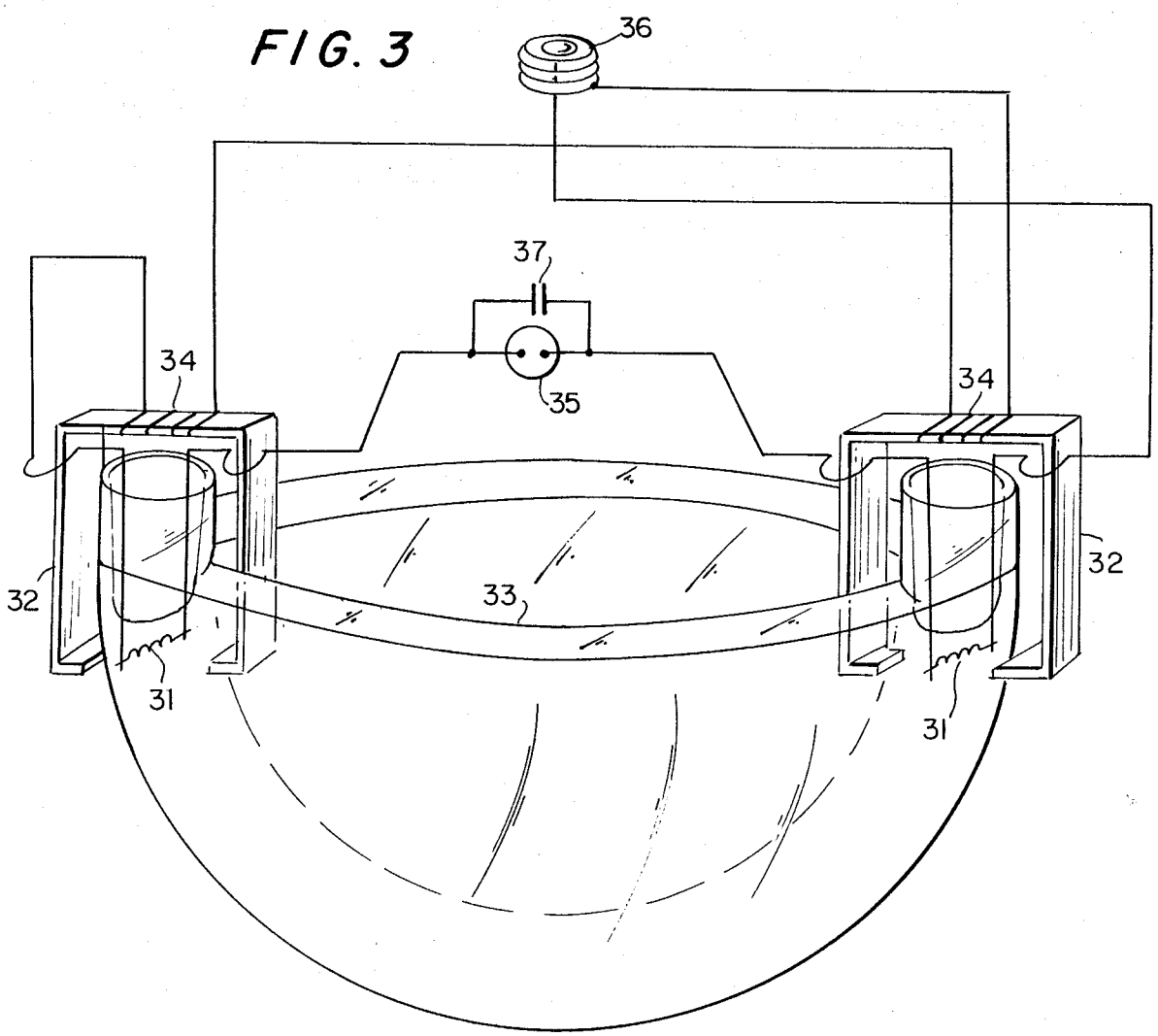
FIG. 3 is a view of one of the magnetic arc spreading coils for the lamps pictures in FIG. 1 and FIG. 2.

The magnetic arc spreading coils 4 for the lamp described in FIG. 1 and FIG. 2 are solenoids consisting a flat core, approximately 1" wide made of laminations of minimal total thickness of about ⅛ inch. A return path 11 for the magnetic flux concentrates the magnetic field in the region of the arc and also service as a retainer for the envelope, the lamp component and a mount for the Edison plug, held implace by plastic screws 12. An alternate design shown in FIG. 3 employs two magnetic arc spreading coils, one in close proximity to each filament 31. The core 32 is C-shaped and fits closely to the outer and inner walls of the envelope and grip and support the lamp envelope 33. The coil 34 is smaller, lighter, while producing a higher field intensity by virtue of the smaller air path for magnetic flux. The two magnetic arc spreading coils are connected in series and form all or part of the ballast for the fluorescent lamp of which they comprise a part.

The arc spreading coils are connected to the filaments 31 which are connected to starter 35. A capacitor 37 is connected in parallel with the starter 35.

To spread the arc throughout the greater extent of the lamp envelope in FIG. 2 when the cylindrical portion of the envelope is extended, the magnetic arc spreading coil is modified to have multiple pole faces, in effect distributing the applied magnetic field over a larger area and increasing its deflecting or spreading effect.

Figure 4:
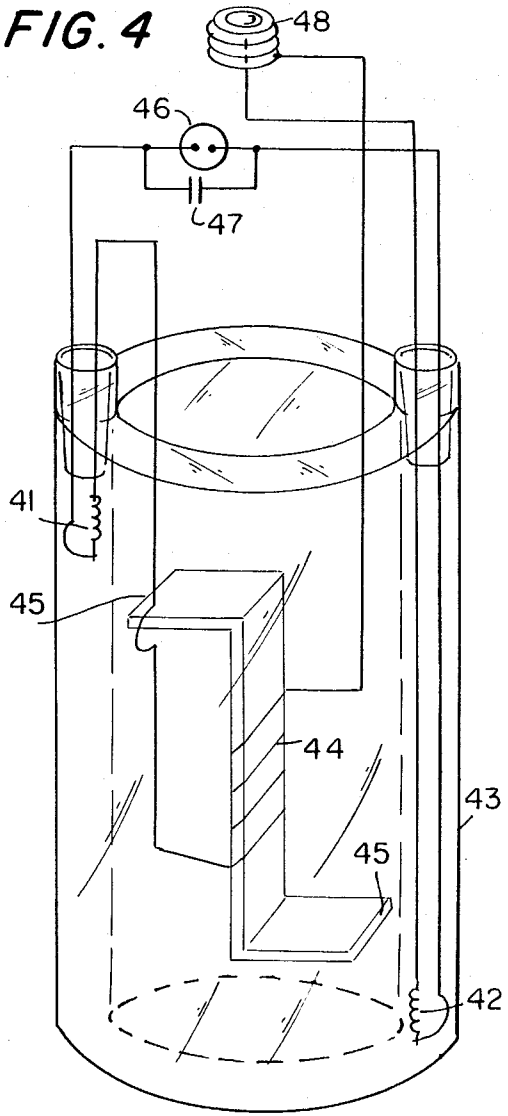
FIG. 4 is a pictorial view of a double cylinder with no partitions which is the envelope for a magnetic arc spreading type fluorescent lamp.

The fluorescent lamp in FIG. 4 is the general shape of one embodiment of the invention of a magnetic arc spreading lamp without partitions. This lamp consists of a double walled envelope with filaments 41, 42, 180° apart and diagonally opposite. The stem supporting filament 42 projects down close to the opposite end of the lamp envelope 43. The magnetic arc spreading coil 44, whose pole faces 45 are in close proximity to the interior wall of the lamp envelope are placed 2 to 4 cm a way from the filaments where the magnetic field of the arc spreading coil has a maximum effect on spreading the arc throughout the volume of the lamp. One terminal of each filament is connected to a starter 46. The arc spreading coil is connected in series with the lamp and a filament terminal and the other end of the arc spreading coil is wired to an Edison screw base 48 on the lamp bezel. A capacitor 47 is connected in parallel with the starter 46. The inside of the interior wall of the lamp envelope is coated with a reflective material, e.g. titanium dioxide to reflect to the ouside the light produced by the phosphor.

Figure 5:
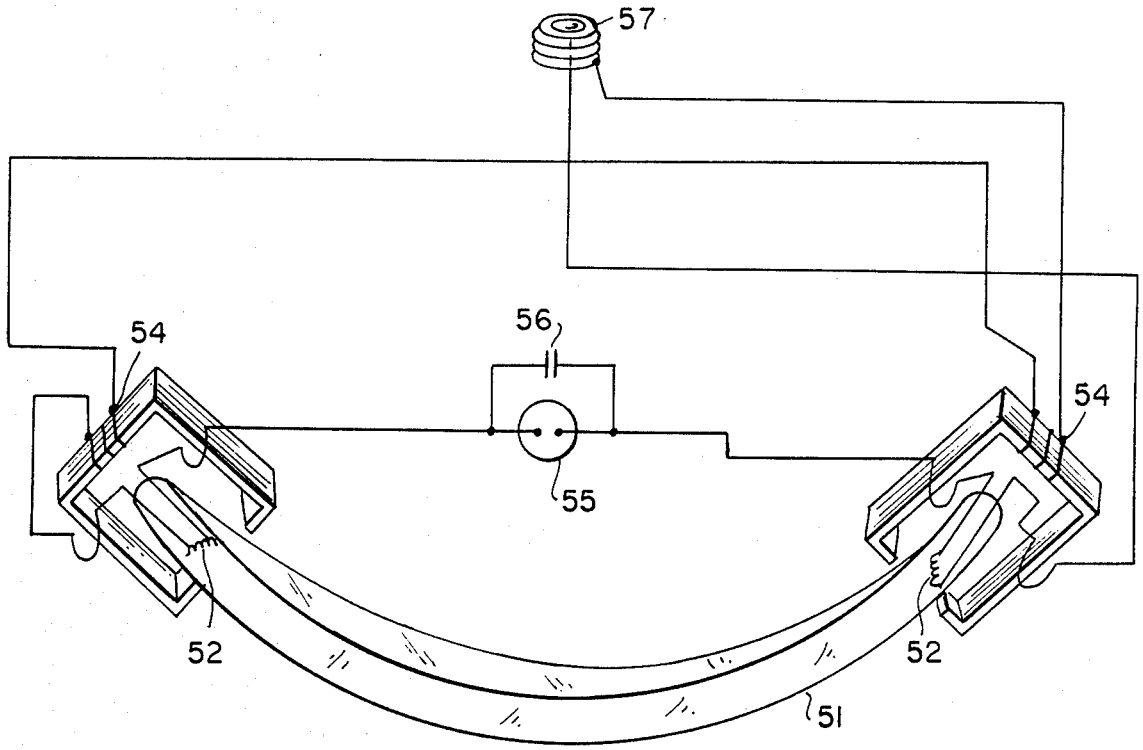
FIG. 5 is a pictorial view of a magnetic arc spreading fluorescent lamp envelope which is clearly described by the phrase "orange peel shape;"

A longer and narrower lamp with magnetic arc spreading is double walled and shaped in the configuration shown in FIG. 5. The envelope 51 is in the shape of an orange peel, or, in other words, is a portion of the surface of a hollow spherical shell. This structure has a constant arc length in any path the arc traverses through the lamp, a condition also true of the lamp envelopes in FIG. 1 and FIG. 2. The interior of the lamp contains argon at a pressure of 1 to 2 mm and approximately 50 mg of mercury and carries the arc discharge. The filaments 52, electrodes, a are the origination and termination points of the arc discharge. The interior cavity of the hemispherical lamp contains the magnetic arc spreading coil 54, whose pole faces are in close proximity to the interior wall of the lamp envelope and placed 2 to 4 cm away from the filaments where the magnetic field of the arc spreading coil 54 has a maximum effect on spreading the arc throughout the volume of the lamp. One terminal of each filament is conncected to a starter 55 and paralleled capacitor 56. The arc spreading coil is connected in series with the lamp and a filament terminal and the other end of the arc spreading coil is wired to an edison screw base 57 on the lamp bezel. The inside of the interior wall of the lamp envelope is coated with a reflective material, e.g. titanium dioxide to reflect to the outside the light produced by the phosphor.

The arc spreading coil produces a magnetic field at right angles to the drift of the plasma in the arc due to the electric field establishing the arc. The orthogonal action of the electric and magnetic fields on the plasma provides a favored plane at right angles to both for spreading, deflecting, diverging or diffusing the arc current. As the magnetic field varies in consonance with the current at 60 Hz, the arc occupies the entire volume of the lamp moving alternately to one side or the other of the lamp from the equilibrium position in the center of the lamp. Magnetic arc spreading coils can be operated at any frequency from 50 Hz to 30 KHz and higher as for any fluorescent lamps. The efficacy of the complete assembly increases as the power line frequency is raised.

The arc discharge in the conventional fluorescent lamp has a circular cross section, with the current density highest in the center and tapering off to a low density at the circumference. The current activates mercury atoms which emit ultraviolet (UV) quanta. The ultraviolet quanta are converted to visible light when absorbed by the phosphor. However, inactivated mercury vapor can absorb the ultraviolet quanta; the gas that sustains the arc discharge is thus also opaque to the ultraviolet produced by the arc. Thus, the diameter chosen for a fluorescent lamp cylinder is a compromise between seeking greater surface area for phosphor and minimizing ultraviolet absorption before the ultraviolet strikes the phosphor. The maximum light output for long cylinders occurs at a diameter of 38 mm (1.5 inches) or less, T12 or smaller lamps. This is the reason for the cylindrical cross section of fluorescent lamps to date, whatever their design, be it U tubes or spirals or power groove.

Magnetic arc spreading frees fluorescent lamp design from this restriction. When the lamp is lit using an external ballast, i.e., without arc spreading, a band of light is visible around the equator of the lamp. With the arc spreading coil energized, the arc occupies the entire volume of the lamp and the full phosphor surface emits light. Further, the magnetic field required no extra components; by appropriate choices, the magnetic field is produced by a coil that also serves as a ballast. The coil has a non-magnetic casing permitting the field to enter the space occupied by the arc. Consequently, no extra components are required for magnetic arc spreading beyond those now associated with fluorescent lamps.

The positive column of the arc discharge is a plasma—an effectively neutral aggregation of positive ions and electrons. In the presence of a magnetic field at right angles to the direction of the arc, the plasma shifts in a direction at right angles to the vectors of both the current and the field, but in a manner different from the motion of an electron beam. Essentially, parired charges are free to diffuse from the high current (and ion) density at the center of the arc toward the low current density regions near the walls of the container, a process called ambipolar diffusion.

With a magnetic field applied diffusion is enhanced in a specific plane and the arc diffuses to fill up that region. The arc current changes direction in consonance with the change in direction of the magnetic field at 60 Hz when this is the line frequency, but the diffusion plane remains unchanged; consequently, diffusion in both the up and the down directions is enhanced alternately. When dealing only with an electron beam, the force would be an $\bar{i} \times \bar{B}$ product and its direction would not change when current and field reversed together.

We have found no mention in the literature of magnetic fields applied to arc discharge lamps to diffuse, spread or deflect the arc. Rather there have been applications of magnetic fields to do the opposite, to stabilize and confine the arc within an axial magnetic field, as did Kim U.S. Pat. No. 3,335,331 to reduce the flickering of a glow discharge lamp with a permanent magnet. Drop et al. U.S. Pat. No. 4,001,615 uses a magnetic field to control the upward bowing due to convection of an HID arc. Plasmas are confined by similar fields in fusion research with Tokomaks and in MHD generators.

Magnetic arc spreading lamps can be operated at higher currents than conventional fluorescent lamps. The magnetically spread arc occupies more lamp volume and has a lower average current density than in conventional lamps.

The action of the magnetic field brings the arc current into closer proximity to the phosphor thus producing more light. Both factors combined to give magnetic arc spreading lamps greater efficacy than their conventional fluorescent lamp counterparts.

Fluorescent lamps utilizing magnetic arc spreading in envelopes without partitions are more compact than their conventional fluorescent lamp counterparts, are single ended and can be fitted with screw bases. They can replace incandescent lamps with substantial energy savings in many applications which now use high wattage lamps—such as high hats and large globe lamps.

The invention described herein is new and novel and Letters Patent is claimed for:

1. An improved magnetic arc spreading device, such as a fluorescent lamp, comprising a double walled hemispherical lamp envelope without any interior partitions of any kind and forming a hemispherical shell volume for an arc discharge, electrode means for forming said arc discharge in said envelope, a luminescent phosphor coating on all interior walls of said envelope, a circuitry means mounted on and within said envelope and a screw base secured to at least a part of said envelope, and magnetic arcs spreading coil means diffusing, deflecting and spreading said arc discharged throughout the entire volume of said envelope; and magnetic arc spreading coil means comprising a solenoid which is at least a part of the ballast for said arc discharge device; and said coil means being connected in series with said electrode means of said envelope with the other end of said coil means being wired to said screw base; whereby greater light output is achieved due to the hemispherical shell volume in the envelope construction which provides considerable more phosphor surface area.

2. A device according to claim 1, including a double walled cylindrical extension of said double walled hemisphere connected thereto and being free of interior partitions.

3. A device according to claim 1, wherein the wattage of said device can be varied by changing the size of the inner and outer diameters of said envelope.

4. A device according to claim 1, wherein the wattage of said device can be varied by changing the spacing between the walls of said envelope.

5. An improved magnetic arc spreading device, such as a fluorescent lamp, comprising a double walled cylindar lamp envelope without any interior partitions of any kind and forming a cylindrical shell volume for an arc discharge, electrode means for forming said arc discharge in said envelope, a luminescent phosphor coating all interior walls of said envelope, a circuitry means mounted on and within said envelope and a screw base secured to at least a part of said envelope, and magnetic arc spreading coil means for diffusing, deflecting and spreading said arc discharged throughout the entire volume of said envelope; said magnetic arc spreading coil means comprising a solenoid which is at least a part of the ballast for said arc discharge device; and said coil means being connected in series with said electrode means of said envelope with the other end of said coil means being wired to said screw base; whereby greater light output is achieved due to the larger phosphor area of the envelope construction.

6. A device according to claim 5, wherein the wattage of said device can be varied by changing the size of the inner and outer diameters of said envelope.

7. A device according to claim 5, wherein the wattage of said device can be varied by changing the spacing between the walls of said envelope.

8. An improved magnetic arc spreading device, such as a fluorescent lamp, comprising a double walled lamp envelope which is a portion of the surface of a sphere in the form of an orange peel shape, without any interior partitions of any kind, electrode means for forming said arc discharge in said envelope, a luminescent phosphor coating all interior walls of said envelope, a circuitry means mounted on and without said envelope and a screw base secured to at least a part of said envelope, and magnetic arc spreading coil means for diffusing, deflecting and spreading said arc discharge throughout the entire volume of said envelope; and said magnetic arc spreading coil means comprises a solenoid which is at least a part of the ballast for said arc discharge device; whereby greater light output is achieved due to the envelope construction which provides considerably more phosphor surface area.

9. An improved magnetic arc spreading device, such as a fluorescent lamp, comprising a double walled hemispherical lamp envelope without any interior partitions of any kind and forming a hemispherical shell volume for an arc discharge, electrode means for forming said arc discharge in said envelope, a luminescent phosphor coating all interior walls of said envelope, a circuitry means mounted on and within said envelope and a screw base secured to at least a part of said envelope, and magnetic arc spreading coil means diffusing, deflecting and spreading said arc discharged throughout the entire volume of said envelope; and said magnetic arc spreading coil means including a pair of magnetic arc spreading coils, one at each end of the arc, both of which comprise at least a part of the ballast for said arc discharge device; and said coil means being connected in series with said electrode means of said envelope with the other end of said coil means being wired to said screw base; whereby greater light output is achieved due to the hemispherical shell volume in the envelope construction which provides considerably more phosphor surface area.

10. A device according to claim 9, wherein said magnetic arc spreading coil means includes a pair of magnetic arc spreading coils, one at each end of the arc, both of which comprise at least a part of the ballast for said arc discharge device to form a magnetic field shaped by said magnetic arc spreading coils to spread, diffuse, deflect, the arc discharge over a wider volume and area.

11. A device according to claim 9, wherein the wattage of said device can be varied by changing the size of the inner and outer diameters of said envelope.

12. A device according to claim 9, wherein the wattage of said device can be varied by changing the spacing between the walls of said envelope.

* * * * *